US005418421A

United States Patent [19]

Hasegawa et al.

[11] Patent Number: 5,418,421

[45] Date of Patent: May 23, 1995

[54] CATHODE-RAY TUBE WITH ELECTROSTATIC CONVERGENCE ELECTRODE ASSEMBLY

[75] Inventors: Kouji Hasegawa; Yukinobu Iguchi; Yoshifumi Nakayama; Youichi Ohshige, all of Kanagawa, Japan

[73] Assignee: Sony Corporation, Tokyo, Japan

[21] Appl. No.: 976,391

[22] Filed: Nov. 13, 1992

[30] Foreign Application Priority Data

Nov. 14, 1991 [JP] Japan ..... 3-299205

[51] Int. Cl.[6] ..... H01J 29/50

[52] U.S. Cl. ..... 313/412; 313/414; 313/449; 313/460; 315/368.15

[58] Field of Search ..... 313/412, 413, 414, 415, 313/425, 428, 432, 434, 437, 439, 449, 460; 315/15, 382, 368.15

[56] References Cited

U.S. PATENT DOCUMENTS

| | | | |
|---|---|---|---|
| 3,696,261 | 10/1972 | Miyaoka | 313/112 |
| 3,883,771 | 5/1975 | Ohgoshi et al. | 313/412 |
| 3,946,266 | 3/1976 | Saito et al. | 313/412 X |
| 4,142,131 | 2/1979 | Ando et al. | 313/412 X |
| 4,443,736 | 4/1984 | Chen | 313/460 X |
| 4,473,775 | 9/1984 | Hosokoshi et al. | 313/414 X |

*Primary Examiner*—Sandra L. O'Shea
*Assistant Examiner*—Ashok Patel
*Attorney, Agent, or Firm*—Hill, Steadman & Simpson

[57] ABSTRACT

A cathode-ray tube has an electron gun sealed in a neck in confronting relationship to the phosphor screen. The electron gun comprises a cathode assembly for emitting three electron beams, a main lens region for passing the electron beams therethrough, the main lens means including a high-voltage electrode or grid closer to the phosphor screen, and an assembly of electrostatic deflection plates, positioned closer to the phosphor screen than the high-voltage electrode, for converging the electron beams as one spot on the phosphor screen. An electrostatic convergence electrode assembly is disposed between the high-voltage electrode and the deflection plates. The electrostatic convergence electrode assembly may comprise three or two juxtaposed flat electrodes having electron beam passage holes. The voltages applied to the high-voltage electrode and the deflection plates are also applied selectively to the three or two electrodes of the electrostatic convergence electrode assembly for applying an astigmatic effect equally to the electron beams.

6 Claims, 11 Drawing Sheets

(X-Axis End Of Screen)

(Screen Center)

CATHODE-RAY TUBE WITH ELECTROSTATIC CONVERGENCE ELECTRODE ASSEMBLY

BACKGROUND OF THE INVENTION

1. Field of the Invention

The present invention relates to a cathode-ray tube, and more particularly to an electron gun for use in a cathode-ray tube.

2. Description of the Prior Art

Recently available color picture tubes employ deflection electrodes of the self-convergence type.

As shown in FIG. 1 of the accompanying drawings, such a self-convergence deflection electrode produces a horizontal deflecting magnetic field with pin-cushion distortion and a vertical deflecting magnetic field with barrel distortion for deflecting and automatically converging three R, G, B electron beams on a phosphor screen.

Since, however, the horizontal and vertical deflecting magnetic fields are distorted in the shapes of a pin-cushion and a barrel, respectively, the spot which is produced by the electron beams on the phosphor screen tends to be defocused or distorted at outer edges of the screen, as shown in FIG. 2 of the accompanying drawings. The electron beam spot is distorted because each of the electron beams which has a certain finite spatial extent is subjected to different forces in different locations on the phosphor screen.

The electron beam spot distortion, at an X-axis end of the phosphor screen, in the horizontal deflecting magnetic field which is distorted in a pin-cushion pattern will be described in greater detail with reference to FIG. 3 of the accompanying drawings. In FIG. 3, an electron beam e passes through the sheet of FIG. 3 in a direction away from the viewer, and four 90°-spaced points A, B, C, D are assumed to be on the peripheral edge of a cross-sectional plane across the electron beam e. Since the magnetic field is stronger in the point B than in the point A, the electron beam e undergoes lateral pull on its opposite sides. At the same time, forces directed toward the center of the electron beam e are applied to the points C, D.

Therefore, the electron beam spot on the phosphor screen is slightly underfocused, i.e., would come to a focus beyond the phosphor screen, in the horizontal direction, and is strongly overfocused, i.e., comes to a focus short of the phosphor screen, and hence diverges to produce a halo, in the vertical direction. FIGS. 4A and 4B of the accompanying drawings schematically show, using an optical lens system simulating the electron gun, how the electron beam is focused at the center and the X-axis end, respectively, of the phosphor screen, the optical lens system including a main lens 31 and a deflection electrode 32. In FIGS. 4A and 4B, the electron beam is emitted from an object point a on a cathode, and is focused at a focus point f. The vertical lens effect of the optical lens system is shown on the upper side of a Z-axis, and the horizontal lens effect of the optical lens system is shown on the lower side of the Z-axis. The above horizontally underfocused and vertically overfocused condition of the electron beam spot is illustrated in FIG. 4B.

The relationship between the size of the electron beam spot and the focusing voltage applied to the deflection yoke is shown in FIGS. 5A and 5B of the accompanying drawings.

At the center of the phosphor screen, as shown in FIG. 5A, focusing voltages Vfv, Vfh applied to bring the electron beam spot into focus vertically and horizontally are equal to each other. The minimum sizes of the electron beam spot in the vertical and horizontal directions are the same. Therefore, the electron beam spot is substantially circular in shape at the center of the phosphor screen.

At the X-axis end, however, the focusing voltage Vfv applied to focus the electron beam spot vertically is higher than the focusing voltage Vfh applied to focus the electron beam spot horizontally by $\Delta$Vfo (about 1.3 kv in FIG. 5B). Furthermore, the minimum sizes of the electron beam spot in the vertical and horizontal directions are different; the horizontal minimum size of the electron beam spot is about 2.5 times greater than the vertical minimum size of the electron beam spot. The voltage difference $\Delta$Vfo is referred to as an astigmatic difference. The corrective voltage applied in a system which employs a dynamic quadruple structure and a dynamic focusing action (described later) is proportional to the astigmatic difference $\Delta$Vfo.

Since the electron beam spot comes to the focus f short of the phosphor screen in the vertical direction as described above, a halo is generated above and below the electron beam spot at the peripheral edge of the phosphor screen, as shown in FIGS. 2 and 4B. As a result, the electron beam spot is distorted due to astigmatism at the peripheral edge of the phosphor screen.

Cathode-ray tubes with non-self-convergence deflection electrodes usually have a quadruple convergence electrode disposed behind the deflection electrodes. The quadruple convergence electrode is supplied with a predetermined current in synchronism with the deflection of the electron beam by the deflection electrode. Usually, the electron beam spot in such cathode-ray tubes is also distorted at the peripheral edge of the phosphor screen in the same fashion as with the self-convergence deflection electrodes.

One solution to the above problem, employed particularly for low-cost cathode-ray tube models, is to make a portion of the electron gun rotationally asymmetrical to produce an astigmatic effect on the electron beam which is opposite to the astigmatism due to the deflection magnetic field for thereby improving the electron beam spot at the peripheral edge of the phosphor screen. Inasmuch as the generated reversal astigmatic effect is fixed, the electron beam spot is necessarily brought out of focus at the center of the phosphor screen.

On the other hand, expensive cathode-ray tube models have an electromagnetic or electrostatic quadruple element near the main lens of the electron gun. The intensity of the converging effect of the quadruple element and the intensity of the focusing effect of the main lens are varied in synchronism with the deflecting action for producing a well-focused electron beam spot on the phosphor screen. Such a system is based on a combination of a dynamic quadruple structure and a dynamic focusing action. More specifically, the intensity of the converging effect of the dynamic quadruple element and the intensity of the focusing effect of the main lens are dynamically adjusted by a circuit arrangement to improve the focus of the electron beam spot at the peripheral edge of the phosphor screen while maintaining the electron beam spot in focus at the screen center.

Actually, the above system is supplied with an AC voltage whose waveform is of a quasi-parabolic shape for improving the focus of the electron beam at the peripheral edge of the phosphor screen. Since the astigmatic difference $\Delta Vfo$ is large, as described above, it is customary to add an AC voltage of about 1 kv to the focusing voltage which is normally in the range of from 5 to 10 kv. Because of the high voltage requirement, the required circuit arrangement becomes expensive.

FIG. 6 of the accompanying drawings shows one recent improvement in an electron gun. In FIG. 6, sheet-like magnets 33 (see FIG. 7 of the accompanying drawings) are attached to an outer surface of the neck of a cathode-ray tube between a fourth grid $G_4$ and a deflection electrode 22. The sheet-like magnets 33 generate a quadruple magnetic field which produces an astigmatic effect that is opposite to the astigmatic action of a main lens 31 for reducing a deflection-induced distortion of the electron beam at the peripheral edge of the screen.

The principle of the above improved electron gun is shown in FIG. 8 of the accompanying drawings, which optically simulates the electron gun. As shown in FIG. 8, the sheet-like magnets 33 are effective in providing a quadruple convergence electrode lens 34 between the main lens 31 and the deflection electrode 32 to select a vertical image magnification $M_v(=b_v/a_v)$ and a horizontal image magnification $M_H$ $(=b_H/a_H)$ such that $M_v>M_H$.

Though the electron beam spot is slightly vertically elongate in shape at the screen center, the dynamic corrective voltage (equal to the astigmatic difference $\Delta Vfo$) applied to the fourth grid $G_4$ is lowered, making the electron beam spot more circular in shape at the peripheral edge of the screen.

While the electron beam spot is greatly improved in shape at the peripheral edge of the screen, however, it is difficult for the quadruple convergence electrode lens 34 produced by the sheet-like magnets 33 to apply an astigmatic effect equally to three electron beams R, G, B.

Heretofore, it has been customary to adjust the spot focus mainly with respect to the electron beam G which bears the information of a green image that is more important regarding visual sensitivity than the other electron beams R, B. Therefore, the spot shapes of the electron beams R, B which bears the information of red and blue images are not improved so much.

OBJECTS AND SUMMARY OF THE INVENTION

It is therefore an object of the present invention to provide a cathode-ray tube which includes a quadruple convergence lens capable of applying an astigmatic effect equally to a plurality of electron beams for improving the spot shapes of the electron beams at the peripheral edge of the phosphor screen and also for reducing a dynamic corrective quantity produced by a circuit arrangement.

According to the present invention, there is provided a cathode-ray tube comprising a phosphor screen, and an electron gun disposed in confronting relationship to the phosphor screen, the electron gun comprising emitting means for emitting three electron beams, main lens means for passing the electron beams therethrough, the main lens means including a high-voltage electrode closer to the phosphor screen, convergence means, positioned closer to the phosphor screen than the high-voltage electrode, for converging the electron beams as one spot on the phosphor screen, and an electrostatic convergence electrode assembly disposed between the high-voltage electrode and the convergence means.

The electrostatic convergence electrode assembly may comprise first, second, and third flat electrodes lying substantially perpendicularly to an axis of the cathode-ray tube, the first electrode being positioned closer to the high-voltage electrode, the third electrode being positioned closer to the convergence means, each of the first and third electrodes having a horizontally elongate rectangular beam passage hole defined therein for passing the electron beams therethrough, the second electrode being positioned between the first and third electrodes and having three separate vertically elongate rectangular beam passage holes defined therein for passing the electron beams respectively therethrough. The cathode-ray tube further includes voltage supply means for applying a higher than normal voltage to the high-voltage electrode and the first and third electrodes, and a lower than normal voltage to the convergence means and the second electrode. The cathode-ray tube also includes a neck, the electron gun being sealed in the neck, the voltage supply means comprises a resistor sealed in the neck.

Alternatively, the electrostatic convergence electrode assembly may comprise lying substantially perpendicularly to an axis of the cathode-ray tube, the first electrode being positioned closer to the high-voltage electrode, the second electrode being positioned closer to the convergence means, the first electrode having three separate vertically elongate rectangular beam passage holes defined therein for passing the electron beams respectively therethrough and flanges extending from respective vertical side edges of the beam passage holes, the second electrode having a horizontally elongate rectangular beam passage hole for passing the electron beams therethrough and flanges extending from respective horizontal edges of the beam passage hole. The cathode-ray tube further includes voltage supply means for applying a higher than normal voltage to the high-voltage electrode and the second electrode, and a lower than normal voltage to the convergence means and the first electrode. The cathode-ray tube also includes a neck, the electron gun being sealed in the neck, and the voltage supply means comprises a resistor sealed in the neck.

The main lens means may also includes correcting means for generating an astigmatic effect on the electron beams in a direction opposite to an astigmatic effect produced by the electrostatic convergence electrode assembly.

The electrostatic quadruple convergence electrode assembly, which is disposed between the high-voltage electrode and the convergence means, is effective in applying an astigmatic effect equally to the three electron beams. The astigmatic effect is uniform and stable as it is generated electrostatically by the electrostatic quadruple convergence electrode assembly.

With the cathode-ray tube according to the present invention, the spot configurations of the electron beams are improved at the peripheral edge of the phosphor screen for increasing the resolution of images displayed on the phosphor screen, and it is possible to reduce a dynamic corrective quantity produced by a circuit arrangement.

The above and other objects, features, and advantages of the present invention will become apparent from the following description of illustrative embodiments thereof to be read in conjunction with the accompanying drawings, in which like reference numerals represent the same or similar objects.

DETAILED DESCRIPTION OF THE PREFERRED EMBODIMENTS

Figure 9A:
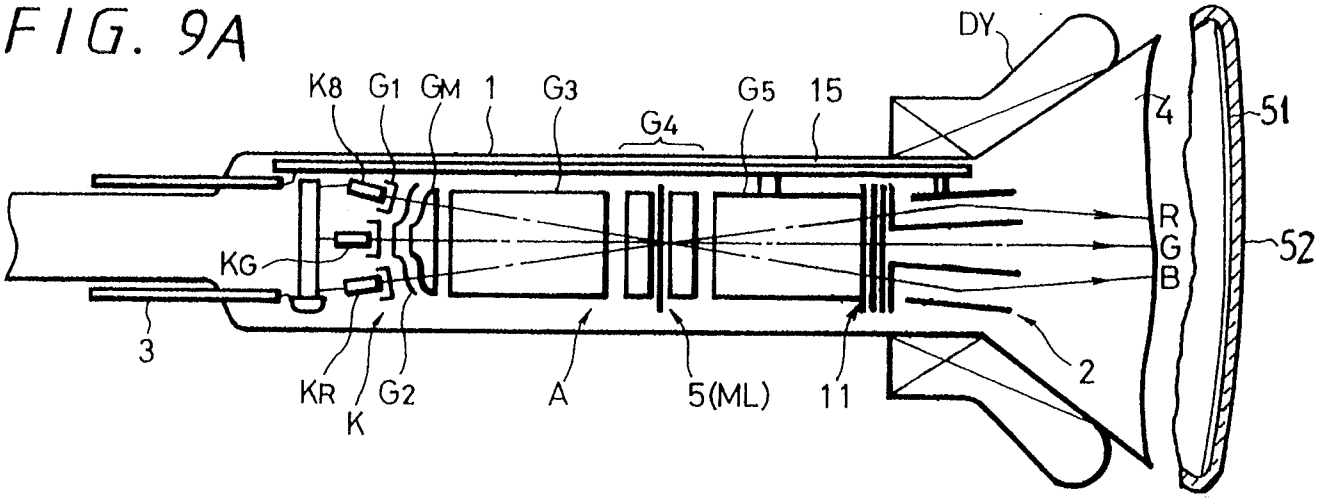
FIG. 9A is a fragmentary horizontal cross-sectional view of a cathode-ray tube, as viewed from above, according to the present invention.

As shown in FIG. 9A, a cathode-ray tube according to the present invention has an electron gun A sealed in a neck 1 which is connected to a funnel 4 which has an end 51 upon which a phosphor 52 is deposited. The electron gun A comprises a cathode assembly K composed of cathodes $K_R$, $K_G$, $K_B$ for generating respective electron beams R, G, B, and an electronic lens system composed of a first grid $G_1$, a second grid $G_2$, an auxiliary electrode $G_M$, a third grid $G_3$, a fourth grid $G_4$, a fifth grid $G_5$, and an assembly of electrostatic deflection plates 2. The electrostatic deflection plates 2 serve to converge the three electron beams R, G, B as one spot on the phosphor screen of the cathode-ray tube.

The cathode assembly K is positioned in a rear end portion of the neck 1 and has terminals 3 projecting rearwardly from the rear end of the neck 1. The first grid $G_1$, the second grid $G_2$, the auxiliary electrode $G_M$, the third grid $G_3$, the fourth grid $G_4$, the fifth grid $G_5$, and the electrostatic deflection plates 2 are successively arranged in the neck 1 in the order named from the cathode K toward the phosphor screen of the cathode-ray tube.

The cathode-ray tube includes a funnel 4 extending from the neck 1 toward the phosphor screen 52. A deflection electrode DY for generating deflection magnetic fields is mounted in the neck 1 and the funnel 4 across the transition therebetween. The third grid $G_3$, the fourth grid $G_4$, and the fifth grid $G_5$ jointly provide a main lens ML positioned at the fourth grid $G_4$. A region where the main lens ML is located is referred to a main lens region 5.

Figure 10:
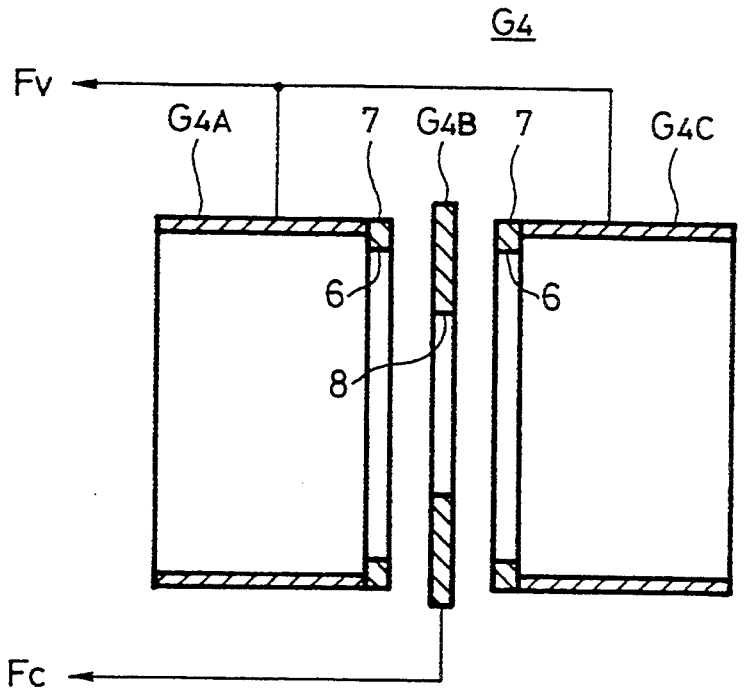
FIG. 10 is a cross-sectional view of a fourth grid, as viewed from above, in the cathode-ray tube shown in FIG. 9.

The fourth grid $G_4$ is of a known built-in quadruple convergent electrode structure. More specifically, as shown in FIG. 10, the fourth grid $G_4$ comprises first, second, and third electrodes $G_{4A}$, $G_{4B}$, $G_{4C}$. The first and third electrodes $G_{4A}$, $G_{4C}$, which are positioned one on each side of the second electrode $G_{4B}$, are cylindrical in shape, and the second electrode $G_{4B}$ is of a flat disc shape (see also FIG. 11C).

Figure 12:
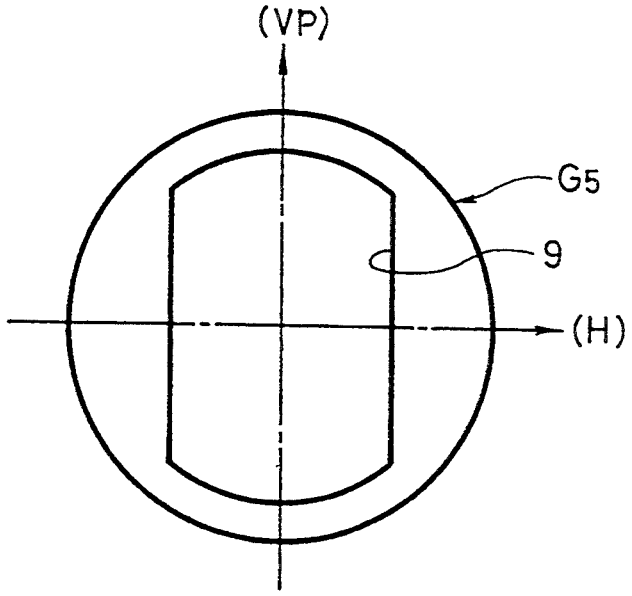
FIG. 12 is a front elevational view of a fifth grid, as viewed from the cathode, in the cathode-ray tube shown in FIG. 9.
Figure 11A:
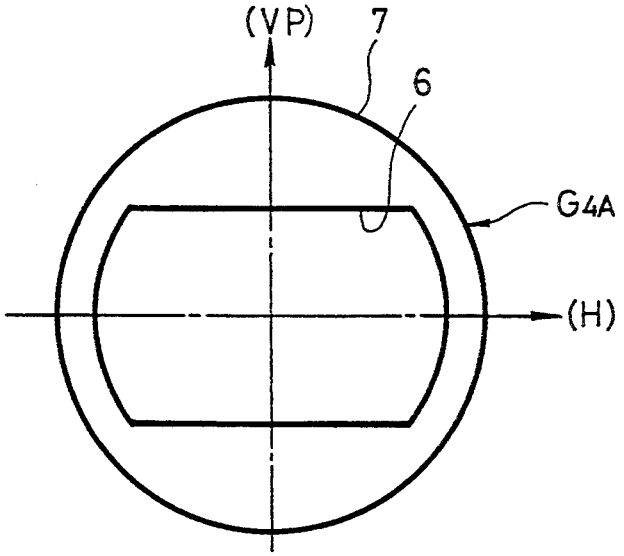
FIG. 11A is a front elevational view of a first electrode, as viewed from the phosphor screen, of the fourth grid.
Figure 11B:
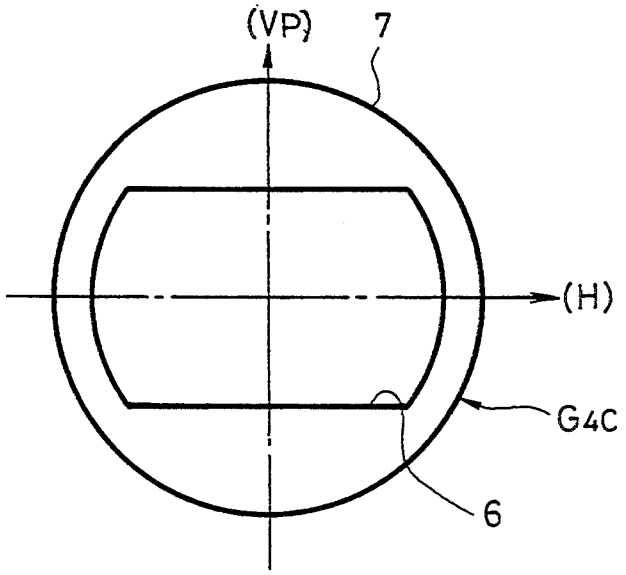
FIG. 11B is a front elevational view of a second electrode, as viewed from the phosphor screen, of the fourth grid.
Figure 11C:
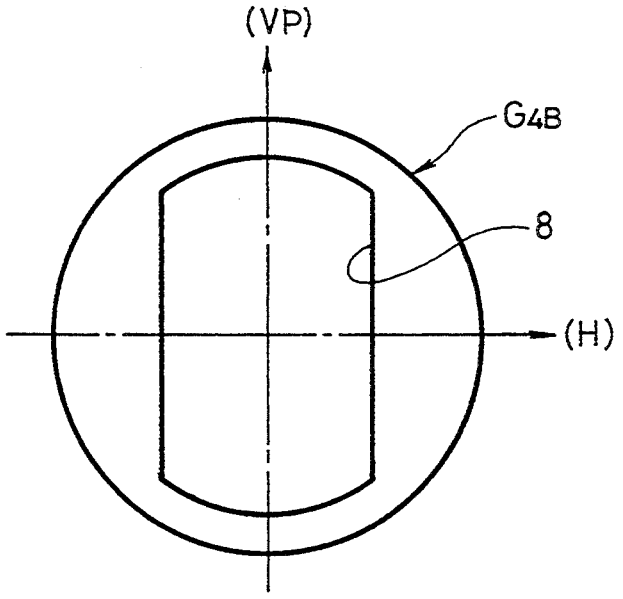
FIG. 11C is a front elevational view of a third electrode, as viewed from the cathode, of the fourth grid.

As also shown in FIGS. 11A and 11B, flat discs 7 with horizontally elongate beam passage holes 6 defined therein are welded or otherwise fixed to respective confronting ends of the first and third electrodes $G_{4A}$, $G_{4C}$. As shown in FIG. 11C, the second electrode $G_{4B}$ has a vertically elongate beam passage hole 8 defined therein. As shown in FIG. 12, the fifth grid $G_5$ has a vertically elongate beam passage hole 9 defined in an end thereof which faces the fourth grid $G_4$.

In operation, a fixed voltage Fc is applied to the second electrode $G_{4B}$, and a focusing voltage Fv is applied to the first and third electrodes $G_{4A}$, $G_{4C}$ in synchronism with the cyclic period of a deflection voltage applied to the deflection plates 2, for producing an electrostatic quadruple convergence response in the main lens region 5. The focusing voltage Fv is corrected to adjust the intensity of the converging effect of the electrostatic quadruple convergence electrode and also the intensity of the focusing effect of the main lens ML for improving the focus of electron beam spots at the peripheral edge of the phosphor screen while maintaining the electron beam spots in focus at the screen center.

Figure 1:
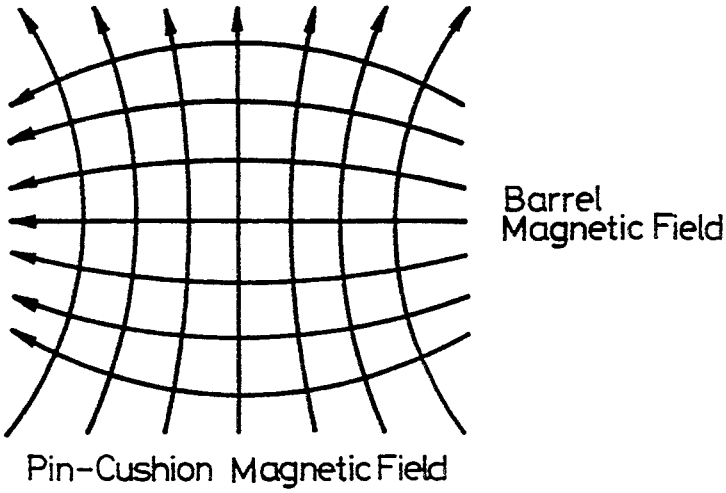
FIG. 1 (PRIOR ART)
FIG. 1 is a diagram showing deflection magnetic fields produced by a deflection electrode of a conventional cathode-ray tube.
Figure 2:
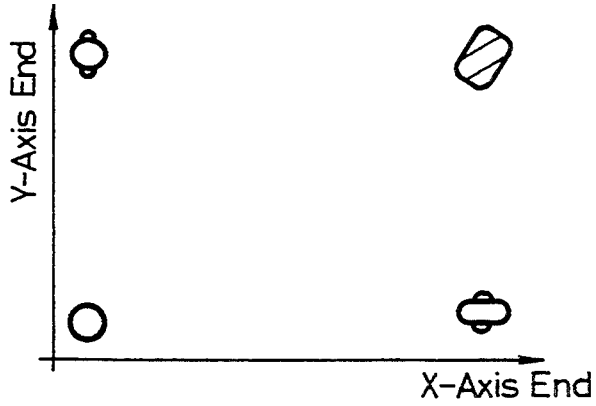
FIG. 2 (PRIOR ART)
FIG. 2 is a diagram showing distortions of electron beam spots in the conventional cathode-ray tube.
Figure 3:
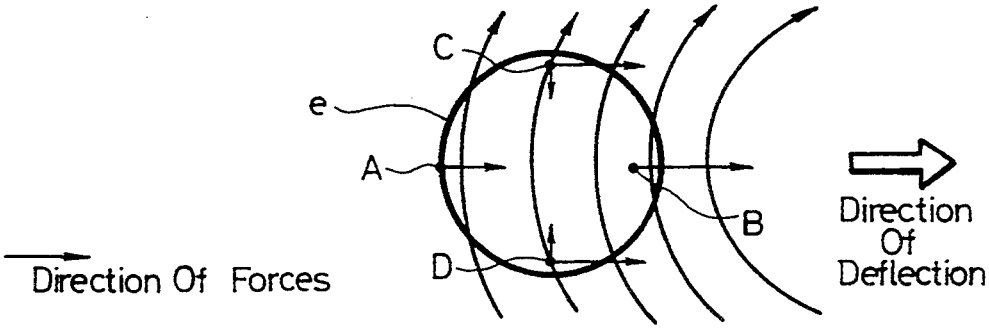
FIG. 3 (PRIOR ART)
FIG. 3 is a diagram showing forces acting on an electron beam at an X-axis end of the phosphor screen of the conventional cathode-ray tube.
Figure 4A:
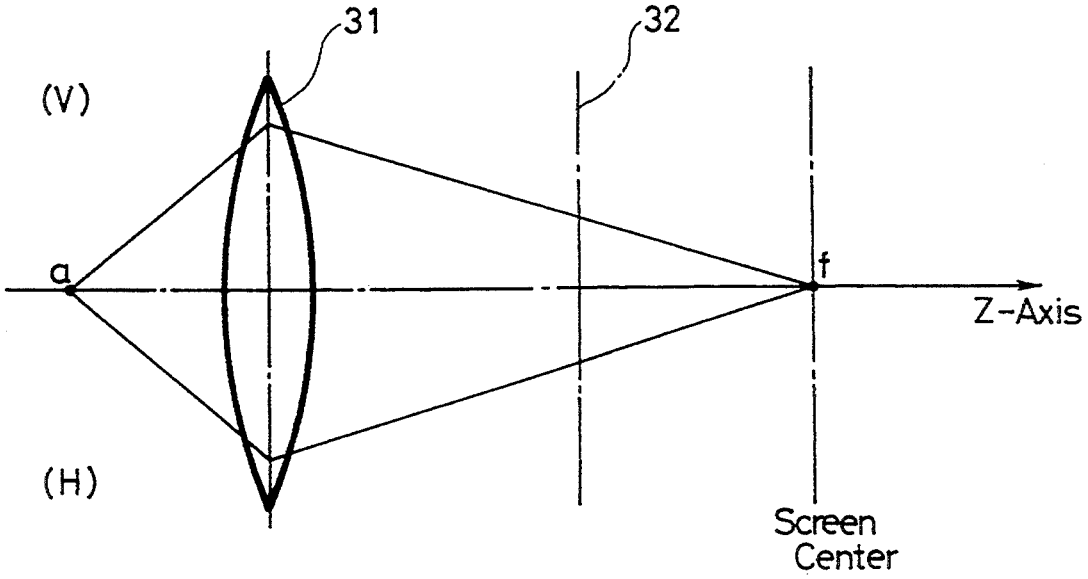
FIG. 4A (PRIOR ART)
FIGS. 4A and 4B are diagrams showing lens effects of the deflection electrode at the center and the X-axis end, respectively, of the phosphor screen of the conventional cathode-ray tube.
Figure 4B:
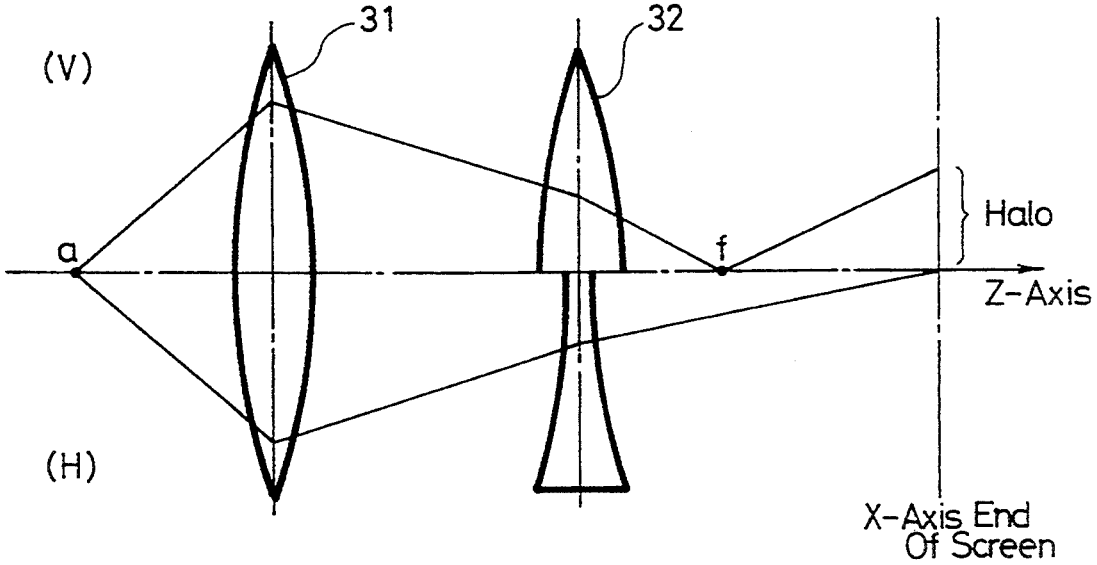
FIG. 4B (PRIOR ART)
Figure 5B:
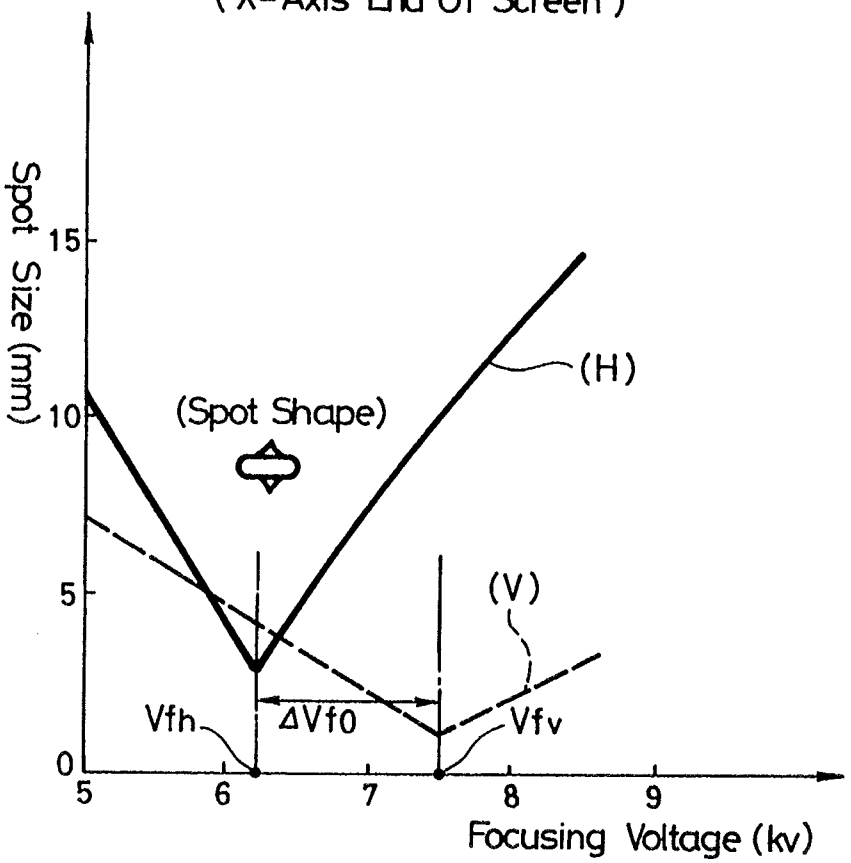
FIG. 5B (PRIOR ART)
FIGS. 5A and 5B are diagrams showing the relationship between spot sizes and focusing voltages at the center and the X-axis end, respectively, of the phosphor screen of the conventional cathode-ray tube.
Figure 5A:
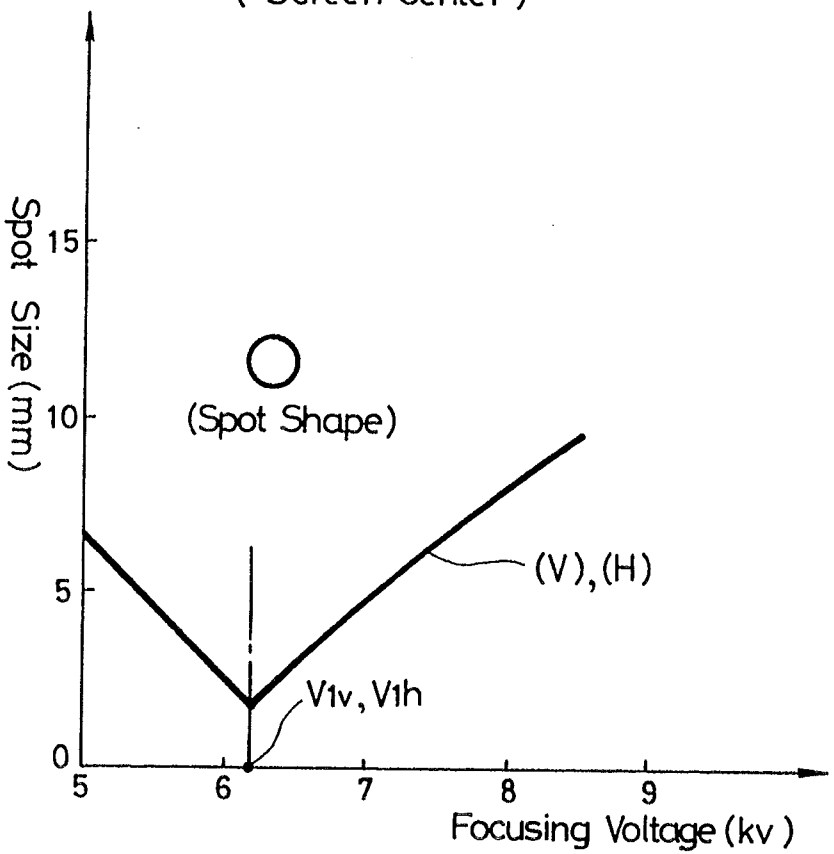
FIG. 5A (PRIOR ART)
Figure 6:
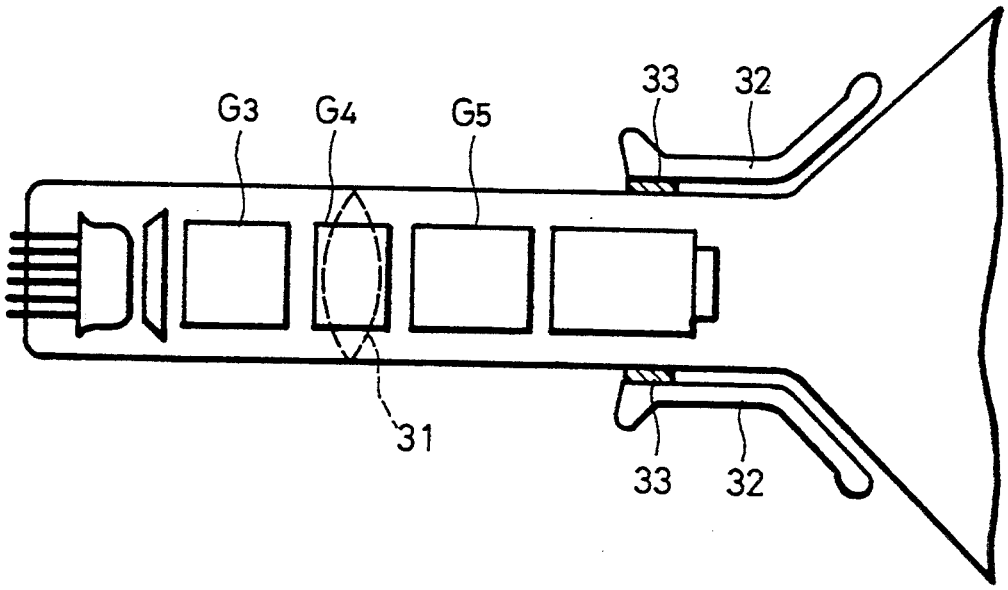
FIG. 6 (PRIOR ART)
FIG. 6 is a fragmentary cross-sectional view of another conventional cathode-ray tube.
Figure 7:
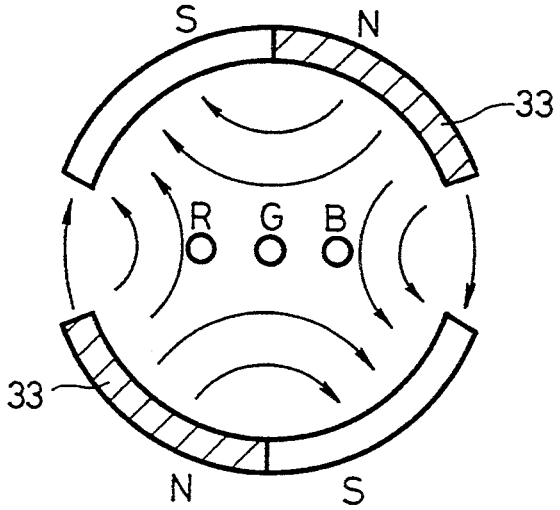
FIG. 7 (PRIOR ART)
FIG. 7 is an enlarged front elevational view of sheet-like magnets, as viewed from the phosphor screen, of the conventional cathode-ray tube shown in FIG. 6.
Figure 8:
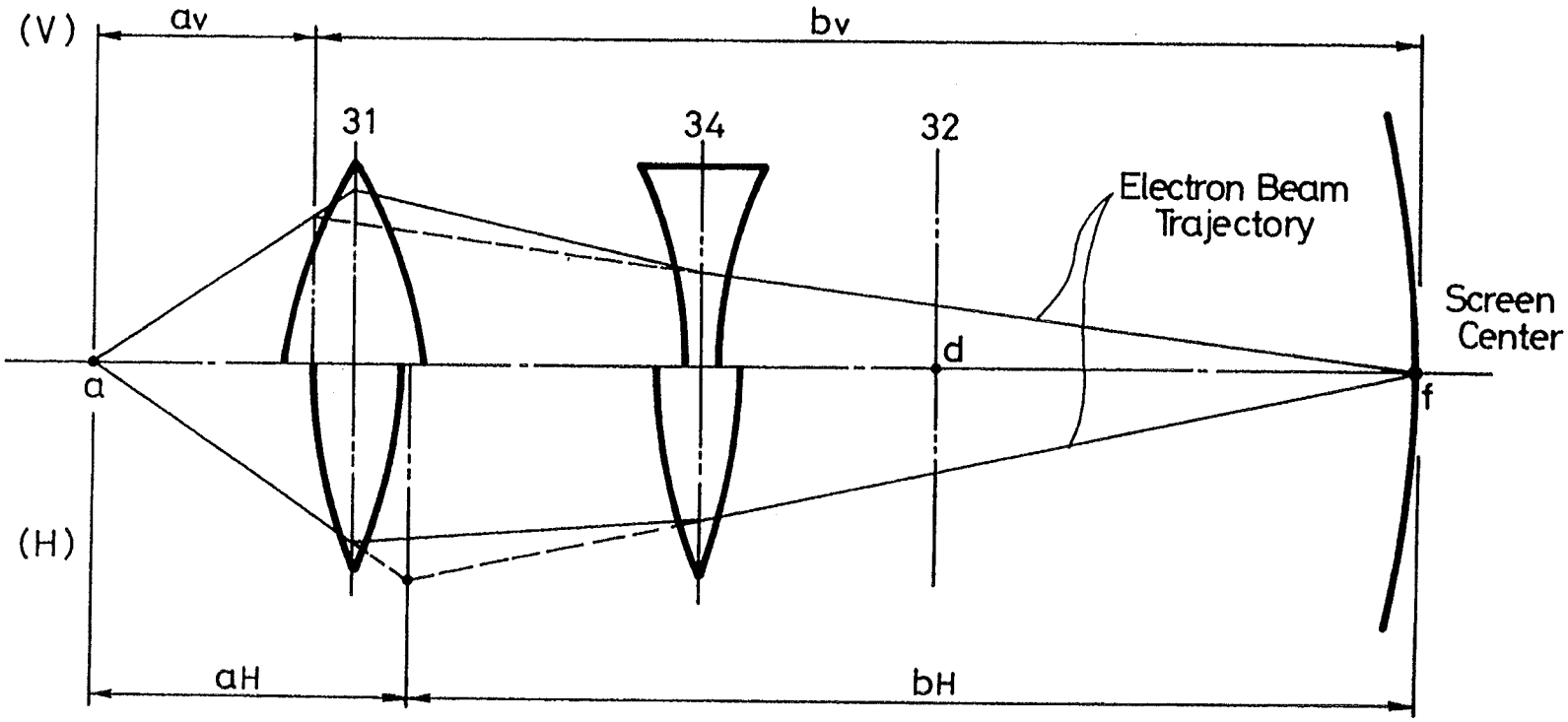
FIG. 8 (PRIOR ART)
FIG. 8 is a diagram showing the manner in which a quadruple convergence lens operates to focus an electron beam in the conventional cathode-ray tube shown in FIG. 6.

Actually, as described above with reference to FIG. 5B, inasmuch as the astigmatic difference ΔVfo is large, it is necessary to add an AC voltage of about 1 kv to the focusing voltage which is normally in the range of from 5 to 10 kv. The high voltage requirement puts a relatively large burden on the required circuit arrangement.

According to the present invention, an electrostatic quadruple convergence electrode assembly 11 for generating an astigmatic effect on the electron beams which is opposite to the astigmatic effect of the built-in quadruple convergent structure in the main lens region 5 is disposed between the fifth grid $G_5$ and the electrostatic deflection plates 2.

Figure 13A:
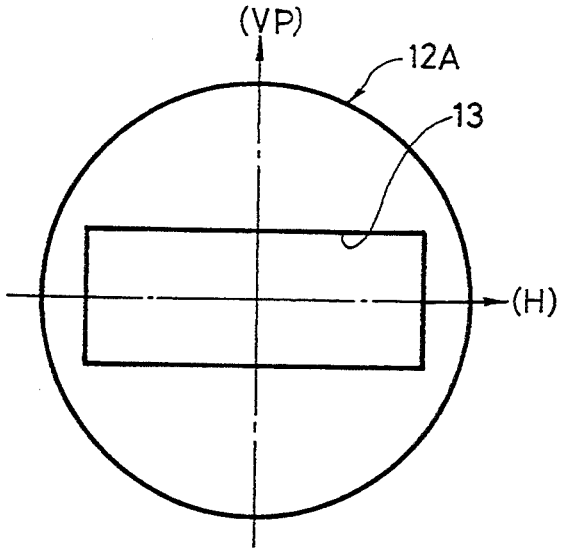
FIG. 13A is a front elevational view of a first electrode, as viewed from the phosphor screen, of an electrostatic quadruple convergence electrode assembly in the cathode-ray tube shown in FIG. 9.
Figure 13B:
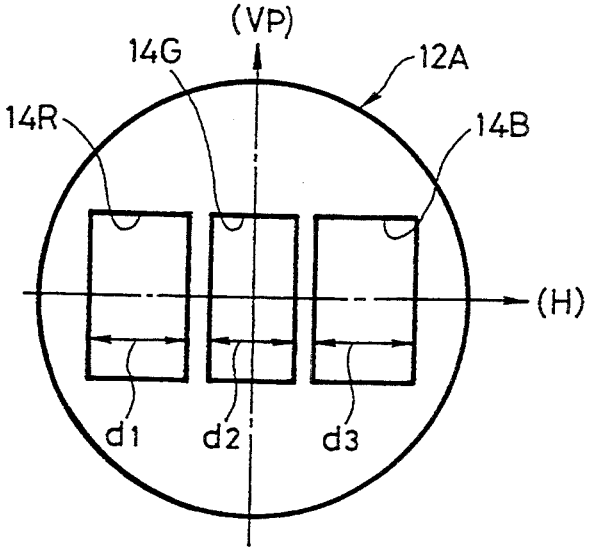
FIG. 13B is a front elevational view of a second electrode, as viewed from the phosphor screen, of the electrostatic quadruple convergence electrode assembly.
Figure 13C:
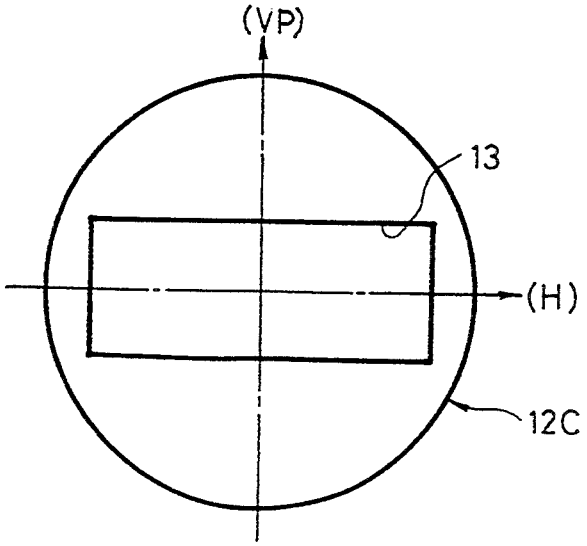
FIG. 13C is a front elevational view of a third electrode, as viewed from the phosphor screen, of the electrostatic quadruple convergence electrode assembly.

As shown at enlarged scale in FIG. 9A, the electrostatic quadruple convergence electrode assembly 11 comprises first, second, and third flat electrodes 12A, 12B, 12C lying perpendicularly to the axis of the cathode-ray tube. As shown in FIGS. 13A through 13C, the electrodes 12A, 12B, 12C comprise metallic flat discs, respectively. The first and third electrodes 12A, 12C, which are positioned one on each side of the second electrode 12B, have horizontally elongate rectangular beam passage holes 13 defined respectively therein and have horizontal longer axes. The second electrode 12B has three separate beam passage holes 14R, 14G, 14B defined therein for passage therethrough of the electron beams R, G, B emitted from the cathode K.

The beam passage holes 14R, 14G, 14B are successively arranged in the horizontal direction. Each of the beam passage holes 14R, 14G, 14B is of a vertically elongate rectangular shape having a vertical longer axis. The beam passage holes 14R, 14B have a horizontal width $d_1$ slightly greater than the horizontal width $d_2$ of the central beam passage hole 14G. The first, second, and third flat electrodes 12A, 12B, 12C with the respective beam passage holes 14R, 14G, 14B jointly provide a quadruple convergence lens for vertically diverging the electron beams and horizontally converging the electron beams.

Figure 9B:
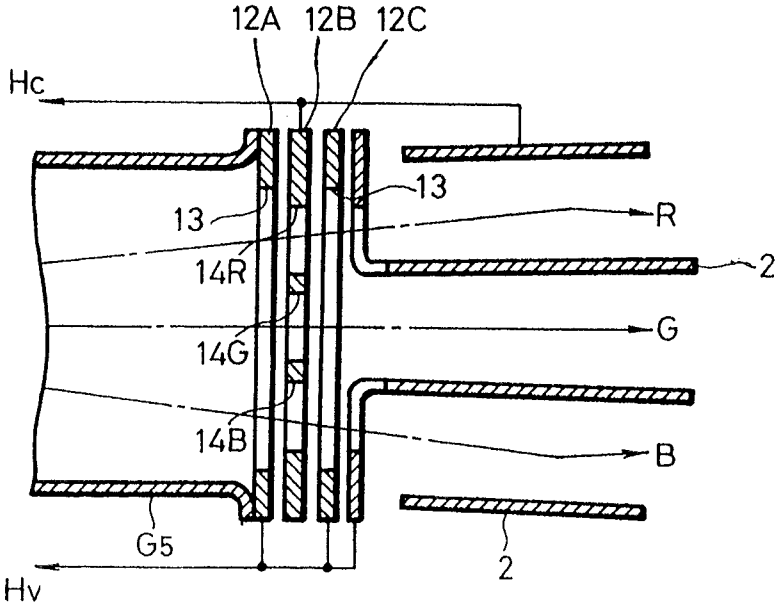
FIG. 9B is a detailed view of the correcting structure.

As shown at enlarged scale in FIG. 9, a high anode voltage Hv, which is also applied to the fifth grid $G_5$, is applied to the first and third electrodes 12A, 12C, and a relatively low convergence voltage Hc, which is also applied to the electrostatic deflection plates 2, is applied to the second electrode 12B. These anode and convergence voltages Hv, Hc are supplied from a resistor 15 which is also sealed in the neck 1.

The electrostatic quadruple convergence electrode assembly 11, which is composed of the first through third electrodes 12A, 12B, 12C and disposed between the fifth grid $G_5$ and the electrostatic deflection plates 2, is effective in applying an astigmatic effect equally to the three electron beams R, G, B. The astigmatic effect is uniform and stable as it is generated electrostatically by the electrostatic quadruple convergence electrode assembly 11.

With the cathode-ray tube described above, the spot configurations of the three electron beams R, G, B can all be improved at the peripheral edge of the phosphor screen for increasing the resolution of images displayed on the phosphor screen, and it is possible to reduce a dynamic corrective quantity produced by a circuit arrangement.

A modified cathode-ray tube will be described below with reference to FIGS. 14 and 15A through 15D.

Figure 14:
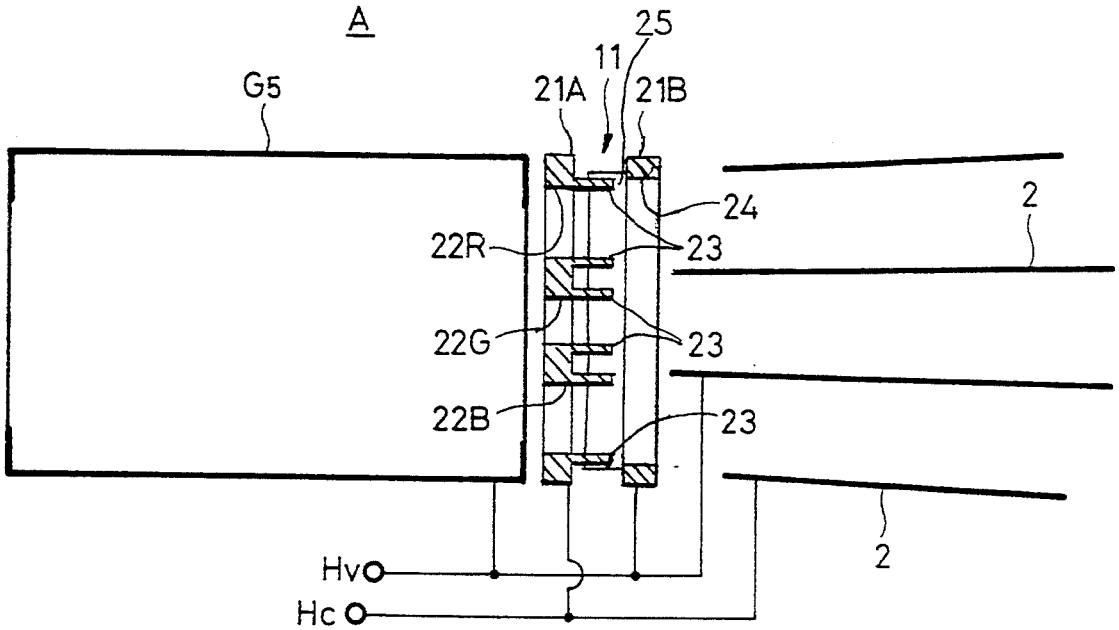
FIG. 14 is a horizontal cross-sectional view of a fifth grid and an electrostatic quadruple convergence yoke electrode assembly in a modified cathode-ray tube.
Figure 15A:
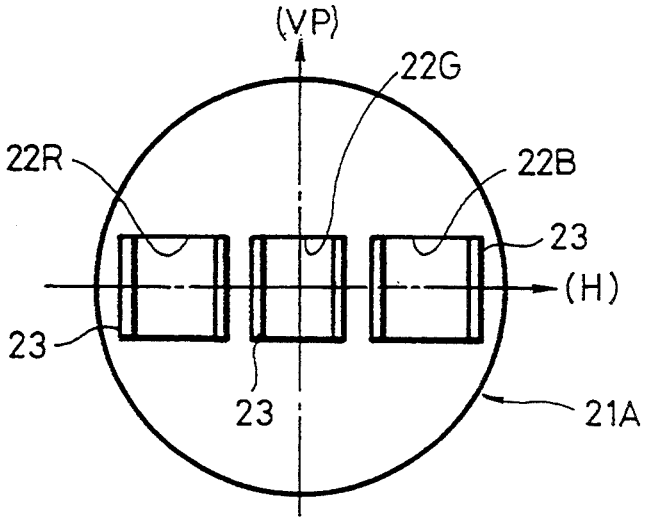
FIG. 15A is a front elevational view of a first electrode, as viewed from the phosphor screen, of the electrostatic quadruple convergence electrode assembly shown in FIG. 14.
Figure 15B:
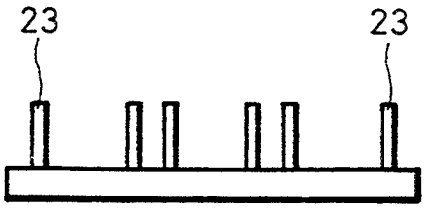
FIG. 15B is a top plan view of the first electrode shown in FIG. 15A.
Figure 15C:
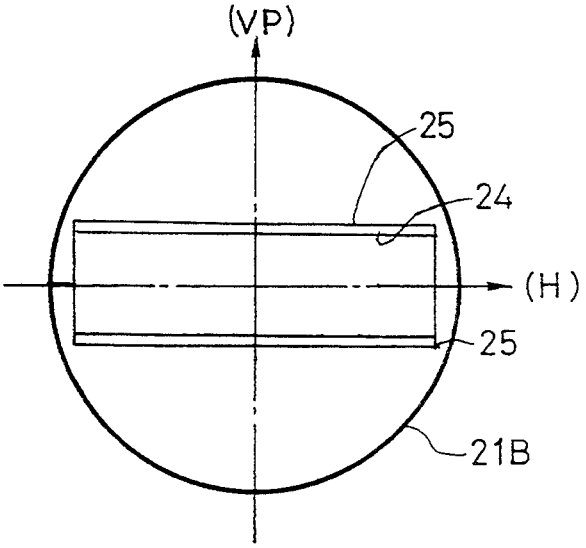
FIG. 15C is a front elevational view of a second electrode, as viewed from the cathode, of the electrostatic quadruple convergence electrode assembly shown in FIG. 14.
Figure 15D:
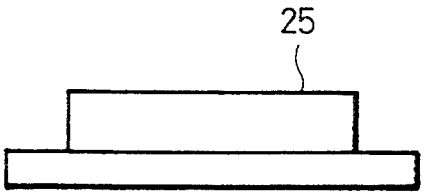
FIG. 15D is a top plan view of the second electrode shown in FIG. 15C.

As shown in FIG. 14, an electron gun A of the modified cathode-ray tube includes an electrostatic quadruple convergence electrode assembly 11 disposed between a fifth grid $G_5$ and an assembly of electrostatic deflection plates 2. The electrostatic quadruple convergence electrode assembly 11 comprises first and second electrodes 21A, 21B in the form of flat metallic discs lying perpendicularly to the axis of the cathode-ray tube.

The first electrode 21A, which is located closer to the fifth grid $G_5$, has three separate beam passage holes 22R, 22G, 22B defined therein for passage therethrough of the electron beams R, G, B emitted from the cathode K. The beam passage holes 22R, 22G, 22B are successively arranged in the horizontal direction and are vertically elongate and rectangular in shape with their longer axes extending vertically. The first electrode 21A also has a total of six flanges 23 extending at a right angle from respective vertical side edges of the beam passage holes 22R, 22G, 22B toward the second electrode 21B. The flanges 23 may be raised from the first electrode 21A or welded to the first electrode 21A.

The second electrode 21B, which is located closer to the electrostatic deflection plates 2, has a single beam passage hole 24 defined therein for passage therethrough of all the electron beams R, G, B emitted from the cathode K. The beam passage hole 24 is horizontally elongate and rectangular in shape with its longer axis extending horizontally. The second electrode 21B also has a pair of flanges 25 extending at a right angle from respective horizontal upper and lower edges of the beam passage hole 24 toward the first electrode 21A. The flanges 25 may be raised from the second electrode 21B or welded to the second electrode 21B.

The first and second electrodes 21A, 21B are arranged such that the flanges 23 and the flanges 25 are disposed in confronting relationship to each other. The convergence voltage Hc is applied to the first electrode 21A, whereas the anode voltage Hv is applied to the second electrode 21B.

The electrostatic quadruple convergence electrode assembly 11 shown in FIGS. 14 and 15A through 15D is also effective in applying an astigmatic effect equally to the three electron beams R, G, B. The astigmatic effect thus applied is uniform and stable as it is generated electrostatically by the electrostatic quadruple convergence electrode assembly 11.

Having described preferred embodiments of the invention with reference to the accompanying drawings, it is to be understood that the invention is not limited to that precise embodiments and that various changes and modifications could be effected by one skilled in the art without departing from the spirit or scope of the invention as defined in the appended claims.

What is claimed is:

1. A cathode-ray tube comprising: a phosphor screen; an electron gun disposed in confronting relationship to said phosphor screen, and electron gun comprising: an emitting means for emitting three electron beams; a main lens means for passing said electron beams therethrough mounted between said emitting means and said phosphor screen and, said main lens comprising a third grid $G_3$, a fourth $G_4$ which includes first, second and third electrodes, and a fifth grid $G_5$ each of said third, fourth and fifth grids successively spaced greater distances from said emitting means; a convergence means mounted between said phosphor screen and said fifth grid for converging said electron beams as one spot on said phosphor screen and including an electrostatic convergence electrode assembly, and wherein said electrostatic convergence electrode assembly comprises first, second and third flat electrodes lying substantially perpendicularly to an axis of the cathode-ray tube, said first flat electrode being positioned close to said high-voltage, fifth grid, said third flat electrode being positioned close to said convergence means, each of said first and third flat electrodes having a horizontally elongate rectangular beam passage hole defined therein for passing said electron beams therethrough, said second flat electrode being positioned between said first and third flat electrodes and having three separate vertically elongate rectangular beam passage holes defined therein for passing said electron beams, respectively, therethrough.

2. A cathode-ray tube according to claim 1, further including voltage supply means for applying a first voltage to said fifth grid and to said first and third flat electrodes, and a second voltage which is lower than said first voltage and to said second flat electrode.

3. A cathode-ray tube comprising: a phosphor screen; an electron gun disposed in confronting relationship to said phosphor screen, said electron gun comprising: an emitting means for emitting three electron beams; a main lens means for passing said electron beams therethrough mounted between said emitting means and said phosphor screen and, and said main lens comprising a third grid $G_3$, a fourth $G_4$ which includes first, second and third electrodes, and a fifth grid $G_5$ each of said third, fourth and fifth grids successively spaced greater distances from said emitting means; a convergence means mounted between said phosphor screen and said fifth grid for converging said electron beams as one spot on said phosphor screen and including an electrostatic convergence electrode assembly, and wherein said electrostatic convergence electrode assembly comprises first, second, and third flat electrodes lying substantially perpendicularly to an axis of the cathode-ray tube, said first flat electrode being positioned close to said high-voltage fifth grid, said third flat electrode being positioned close to said convergence means, each of said first and third flat electrodes having a horizontally elongate rectangular beam passage hole defined therein for passing said electron beams therethrough, said second flat electrode being positioned between said first and third flat electrodes and having three separate vertically elongate rectangular beam passage holes defined therein for passing said electron beams, respectively, therethrough, further including voltage supply means for applying a first voltage to said fifth grid and to said first and third flat electrodes, and a second voltage which is lower than said first voltage to said second flat electrode, and further including a neck, said electron gun being sealed in said neck, said voltage supply means comprises a resistor sealed in said neck.

4. A cathode-ray tube comprising: a phosphor screen; an electron gun disposed in confronting relationship to said phosphor screen, said electron gun comprising: an emitting means for emitting three electron beams; a main lens means for passing said electron beams therethrough mounted between said emitting means and said phosphor screen and, said main lens comprising a third grid, a fourth grid which includes first, second and third electrodes and a fifth grid and each of said third, fourth and fifth grids successively spaced greater distances from said emitting means,; a convergence means mounted between said phosphor screen and said fifth grid for converging said electron beams as one spot on said phosphor screen, and including an electrostatic convergence electrode assembly, and wherein said electrostatic convergence electrode assembly lies substantially perpendicularly to an axis of the cathode-ray tube, and includes first and second flat electrodes, said flat first electrode having three separate vertically elongate rectangular beam passage holes defined therein for passing said electron beams, respectively, therethrough and flanges extending from respective vertical side edges of said beam passage holes, said second flat electrode having a horizontally elongate rectangular beam passage hole for passing said electron beam therethrough and flanges extending from respective horizontal edges of said beam passage hole.

5. A cathode-ray tube according to claim 4, further including voltage supply means for applying a first voltage to said fifth grid and to said second flat electrode, and a second voltage which is lower than said first voltage and to said first flat electrode.

6. A cathode-ray tube comprising: a phosphor screen; an electron gun disposed in confronting relationship to said phosphor screen, said electron gun comprising: an emitting means for emitting three electron beams; a main lens means for passing said electron beams therethrough mounted between said emitting means and said phosphor screen and, said main lens comprising a third grid, a fourth grid which includes first, second and third electrodes and a fifth grid and each of said third, fourth and fifth grids successively spaced greater distances from said emitting means, a convergence means mounted between said phosphor screen and said fifth grid for converging said electron beams as one spot on said phosphor screen, and including an electrostatic convergence electrode assembly, and wherein said electrostatic convergence electrode assembly lies substantially perpendicularly to an axis of the cathode-ray tube, and includes first and second flat electrodes, said first flat electrode having three separate vertically elongate rectangular beam passage holes defined therein for passing said electron beams, respectively, therethrough and flanges extending from respective vertical side edges of said beam passage holes, said second flat electrode having a horizontally elongate rectangular beam passage hole for passing said electron beam therethrough and flanges extending from respective horizontal edges of said beam passage hole, further including voltage supply means for applying a first voltage to said fifth grid and to said second flat electrode, and a second voltage which is lower than said first voltage to said convergence means and to said first flat electrode, and further including a neck, said electron gun being sealed in said neck, said voltage supply means comprises a resistor sealed in said neck.

* * * * *